US005893301A

United States Patent [19]

Hensley et al.

[11] Patent Number: 5,893,301

[45] Date of Patent: Apr. 13, 1999

[54] BOTTLE OPENER

[76] Inventors: Carroll Gene Hensley; Constance Ann Hensley, both of 3769 Hwy. 11E, Limestone, Tenn. 37681

[21] Appl. No.: 08/934,930

[22] Filed: Sep. 22, 1997

[51] Int. Cl.[6] ..... B67B 7/44

[52] U.S. Cl. ..... 81/3.09; 81/3.29; 7/156

[58] Field of Search ..... 81/3.29, 3.4, 3.07, 81/3.09; 7/151, 156

[56] References Cited

U.S. PATENT DOCUMENTS

| | | | |
|---|---|---|---|
| 786,892 | 4/1905 | Happe . | |
| 1,954,422 | 4/1934 | McIntyre . | |
| 1,960,531 | 5/1934 | Driscoll . | |
| 2,227,421 | 1/1941 | Bjork | 30/2 |
| 2,246,649 | 6/1941 | West | 81/3.4 |
| 2,631,482 | 3/1953 | Rinehart | 81/3.4 |
| 3,812,741 | 5/1974 | Heine | 81/3.4 |
| 3,919,901 | 11/1975 | Braman | 81/3.4 |
| 4,704,924 | 11/1987 | Echols | 7/151 |
| 4,790,220 | 12/1988 | Lloyd | 81/3.09 |
| 4,798,300 | 1/1989 | Ghosh et al. | 81/3.09 |
| 4,926,721 | 5/1990 | Hsiao | 81/177.4 |
| 5,022,288 | 6/1991 | Taktakian | 81/3.4 |
| 5,287,775 | 2/1994 | Moore | 81/121.1 |
| 5,483,854 | 1/1996 | King et al. | 81/3.4 |

FOREIGN PATENT DOCUMENTS

| | | | |
|---|---|---|---|
| 12608 | of 1907 | United Kingdom | 81/3.4 |
| 183821 | 3/1923 | United Kingdom . | |

*Primary Examiner*—David A. Scherbel
*Assistant Examiner*—Joni B. Danganan
*Attorney, Agent, or Firm*—Luedeka, Neely & Graham PC

[57] ABSTRACT

A bottle opener for opening bottles of the type having a threaded cap secured to a threaded opening and a seal provided by sheet material secured over at least a portion of the cap and a portion of the bottle. The opener includes a cap engaging member for unthreading the cap and an edge movably positionable against the seal for disruption of the seal during unthreading of the cap.

11 Claims, 2 Drawing Sheets

BOTTLE OPENER

FIELD OF INVENTION

The invention relates generally to devices for opening bottles. More particularly, the invention relates to devices for opening bottles of the type having a twist-off cap and a paper or foil wrapper around the cap and neck of the bottle.

BACKGROUND AND SUMMARY OF THE INVENTION

Bottle openers have been provided for prying a cap off of the lip of a bottle. Typically, such openers include an edge which is engageable with the underside or bottom edge of the cap and an upward pressure is applied to the opener to deform the bottom edge of the cap to disengage the cap from the bottle. The seal between the cap and the bottle is disrupted and because the cap is deformed, the cap cannot be replaced on the bottle.

Many bottles, such as bottles for beer and wine coolers, have threads around the lip of the bottle and are fitted with caps that thread onto the lip of the bottle. Thus, it is possible to open the bottle by hand by twisting the cap instead of prying it open. Many people have trouble opening twist-off caps. Gripping, twisting or manipulating small objects such as bottle caps can be difficult for some people, such as people with arthritis. In addition, many people experience pain or discomfort when attempting to twist the cap off of a bottle. Because the bottle caps are typically made of crimped metal and the metal edges are often sharp, many people are unable to apply a sufficient gripping and twisting force to remove the cap with their bare hands without causing themselves pain or even injury.

Twisting the cap as opposed to prying it off allows the cap to be removed without deforming the cap. This is desirable to enable the cap to be replaced on the bottle to preserve the contents therein. However, this also represents a security risk, as the cap may be removed, the contents tampered with and the cap replaced. For security and aesthetic purposes, modern bottles also often have a paper or foil wrapper which covers the cap and neck of the bottle. The wrapper forms a detachable seal between the cap and the bottle. The bottle cap cannot be removed until the paper or foil wrapper has been cut or torn, breaking the seal between the bottle cap and the neck of the bottle. Thus, the bottle wrapper serves many purposes. It is decorative and often includes markings identifying the product. Also, because consumers are concerned about possible tampering of products, it can serve as an indicator of whether the bottle cap has been removed. Thus, an intact bottle wrapper seal indicates that the bottle cap has not been removed.

Removal of the cap generally leaves a significant portion of the paper or foil seal remaining around the lip of the bottle which may contact the mouth of the user and interfere with the drinking of the contents. Typically, the user must manually tear portions of the seal away from the area of the bottle adjacent the cap before consuming the beverage.

Accordingly, it is an object of the present invention to provide a device for removing and replacing twist-off type bottle caps from bottles of the type having a wrapper covering the cap and a portion of the bottle.

It is yet another object of the invention to provide a device of the character described which enables removal and replacement of the cap without damaging the cap.

It is an additional object of the invention to provide a bottle opener which is easy to use, especially for people who have trouble gripping, twisting or otherwise manipulating small objects.

It is a further object of the invention to provide a bottle opener which will prevent discomfort or injury to persons who experience pain when applying the force necessary for opening threaded cap bottles with their bare hands.

It is yet another object of the invention to provide a bottle of the character described having ergonomics for effective and safe operation.

It is another object of the invention to provide an apparatus for the disruption of the paper or foil wrapper of the type forming a seal between the bottle cap and the neck of the bottle.

Having regard to the foregoing and other objects, the present invention is directed to a device for opening and closing bottles of the type having a threaded cap over a top opening of the bottle and a seal provided by a sheet material secured to the cap and at least a portion of the bottle. According to the invention, the opener includes a housing member having a generally U-shaped cross section, the housing member including an outer surface configured for grasping by a hand of a user and an interior portion configured to receive both the cap of the bottle and an upper portion of the bottle below the cap over which at least a portion of the sheet material is attached.

A cap engaging member is rigidly secured adjacent the interior portion of the housing for receivably engaging at least a portion of the cap when the cap is inserted into the interior portion of the body member such that when the body is moved opposite the threaded direction of the cap, the cap is caused to move with the cap engaging member to unthread the cap from the bottle.

A cutting surface, preferably provided by a steel ring having a sharpened edge, is positioned adjacent the inner portion of the housing and is positionable for contact with the sheet material at a location below the bottle cap for disruption of the sheet material during unthreading of the cap from the bottle.

In one embodiment, the housing includes a covering, such as a textured rubber sheet material attached to the outer surface of the housing. The lower edge of the covering preferably extends below the housing and includes a circumferential groove on its lower interior edge sized to retain the steel ring. During use of the opener, the lower edge of the covering may be squeezed by the user to urge the cutting edge of the ring against the paper or foil seal to cut the seal so that when the cap is removed, so is the portion of the seal above the cutting ring.

In another embodiment, the housing includes a leg portion which extends below the cap engaging member. This portion of the housing is relatively thin and is thus pliable such that a cutting ring received within a groove provided thereon may be urged against the bottle to cut the seal in a like manner.

As will be appreciated, bottle openers according to the invention are particularly advantageous in that they provide a larger gripping surface, i.e., taller and wider than the cap of the bottle. The bigger gripping surface is especially beneficial for persons who have trouble with gripping, holding, manipulating or applying force to small objects, such as people with arthritis or with tender skin that tends to be injured when gripping the sharp metal of the cap. In addition, the openers enable removal of both the cap and the seal in one motion, thus avoiding the need for the user to thereafter tear the seal to remove it from interfering with consumption of the contents of the bottle.

BRIEF DESCRIPTION OF THE DRAWINGS

The above and other features of the invention will be further described in the following detailed specification considered in conjunction with the accompanying drawings (not to scale) in which.

DETAILED DESCRIPTION

Figure 1:
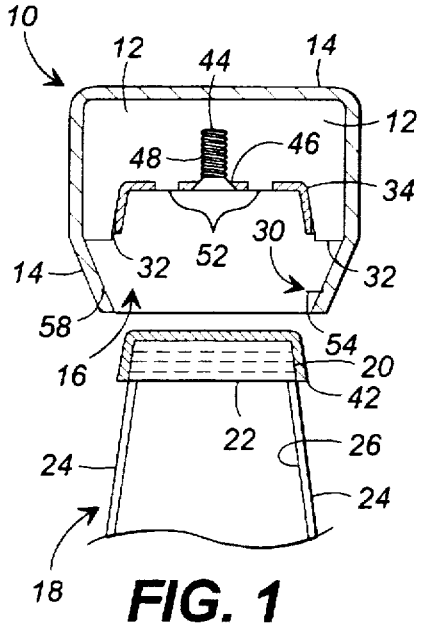
FIG. 1 is a cross-sectional view of a bottle opener in accordance with the invention.

With initial reference to FIG. 1, there is shown a bottle opener 10 in accordance with the invention. In a preferred embodiment, the opener 10 includes a housing member 12 having a generally U-shaped cross-section, an outer covering 14 and a blind bore 16. As shown in FIG. 1, the opener 10 is suitable for use in opening a bottle 18 of the type having a cap 20 threadably received onto a threaded lip 22 of the bottle 18 and a foil or paper seal 24 secured as by glue over at least a portion of the cap 20 and neck 26 of the bottle 18.

Figure 4:
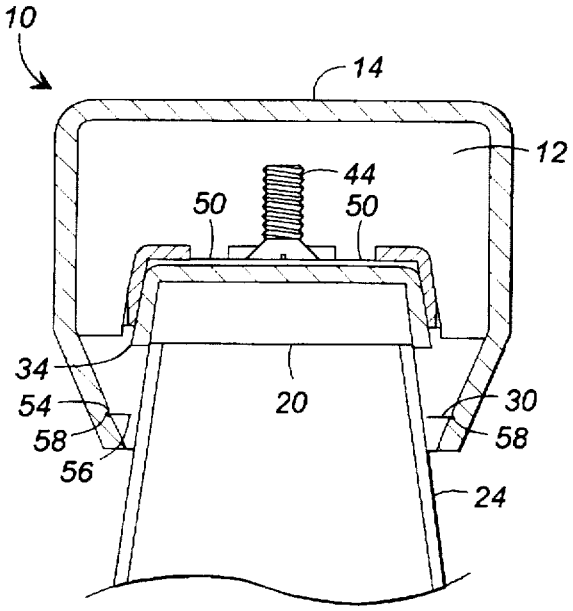
FIG. 4 is a cross-sectional view of the opener of FIG. 1 positioned relative to a bottle for removal of a cap therefrom.
Figure 5:
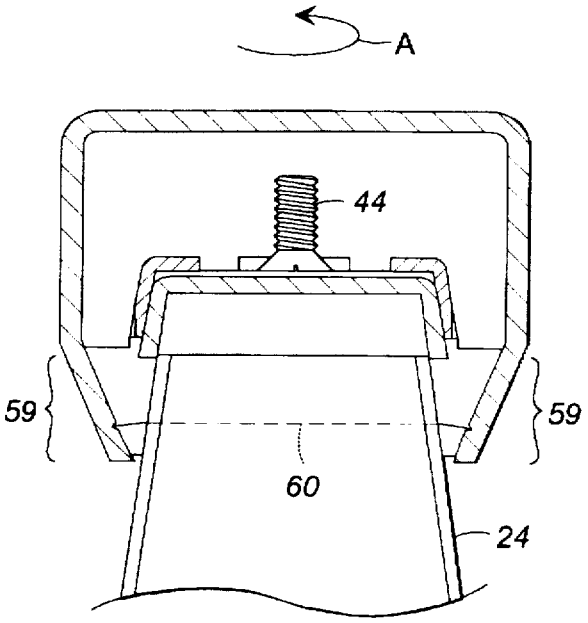
FIG. 5 is another view of the opener as shown in FIG. 4 shown during operation to remove the cap and cut the paper or foil seal.

The housing 12 is preferably of one-piece molded plastic construction having an ergonomic exterior shape configured for secure and comfortable gripping by the hand of a user so as to facilitate effective and safe operation of the opener by a user. In this regard, the outer diameter is preferably sufficient to provide the user sufficient torque to easily unscrew bottle caps using only minor force. Also, the outer covering 14 of the housing is preferably provided as by a layer of relatively high friction sheet material such as textured rubber, plastic or leather adhered as by glue to the exterior of the housing 12 to enhance the ability of a user to grip the opener 10 during use. As will be explained in more detail below, the covering 14 preferably extends a distance of between 0.5 cm to about 1.5 cm below the housing 12 such that a cutting surface 30 provided adjacent the interior of the covering 14 is adjacent the seal 24 when the bottle 18 is received within the bore 16 during opening of the bottle. The cutting surface 30 may be positioned in contact with the neck 26 of the bottle 18 for cutting of the seal 24 during removal of the cap 20 from the bottle 18 by application of pressure by the user as shown in FIGS. 4 and 5.

Figure 2:
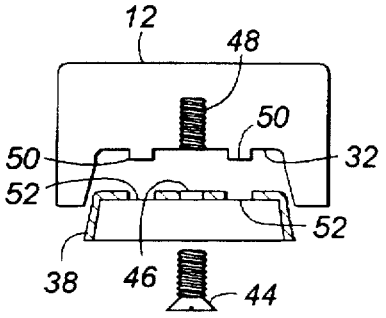
FIG. 2 is a cross-sectional view of components of the opener of FIG. 1.
Figure 3:
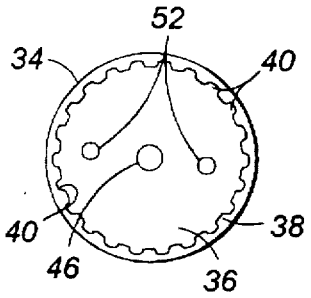
FIG. 3 is a bottom plan view of one of the components of FIG. 2.

With reference to FIGS. 2 and 3, the housing 12 preferably includes a lower recessed surface 32 configured for matingly receiving a cap engagement member 34. The member 34 is configured for frictionally receiving the cap 20 during use of the opener to remove the cap 20 from the bottle 18. Preferably the member 34 is provided by a one-piece metal member configured to conform to the outer surface of a typical screw-on bottle cap.

In this regard, the member 34 preferably includes an upper portion 36 which is substantially circular and flat to bear against the flat top of the cap 20 and a depending sidewall 38 having ridges 40 provided thereon for engaging the ribbed exterior sidewall 42 of the cap 20. The upper portion 36 located in the bore of member 34 generally has a diameter from about 2.5 cm to about 2.8 cm, which is the general diameter of a standard bottle cap. In addition, the member 34 generally contains about 19 of the ridges 40, which corresponds generally to the number of crimped metal protuberances found on the ribbed exterior of a standard bottle cap. The cap engaging member 34 preferably provides a depth of from about 5.0 mm to about 7.0 mm deep, which corresponds generally to the height of a standard bottle cap.

The member 34 is preferably rigidly connected to the surface 32 of the housing as by a threaded screw 44 inserted through an aperture 46 provided through the center portion of the upper portion 36 of the member 34 and received into a threaded opening 48 provided into a central portion of the housing adjacent the surface 32. To inhibit rotational movement of the member 34 during removal or replacement of the cap 20 from the bottle 18 a pair of rigid protuberances 50 are preferably co-formed with the member to extend downwardly from the surface 32 to be received within corresponding apertures 52 provided through the upper portion 36 of the member 34.

Figure 8:
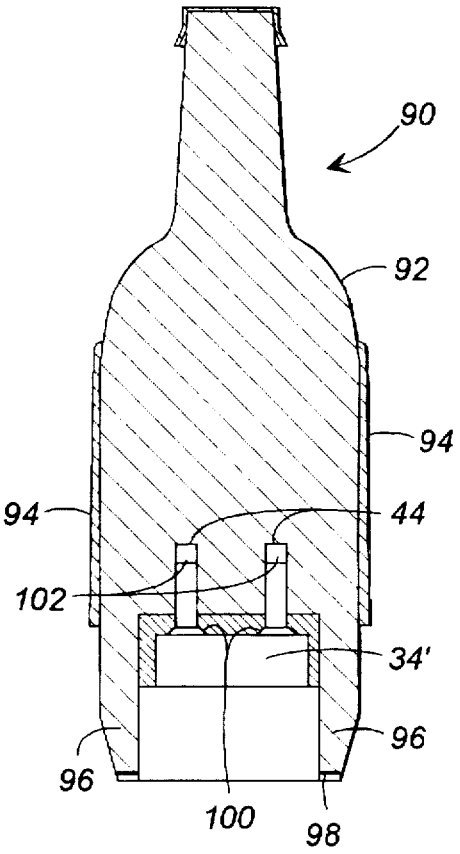
FIG. 8 is a cross sectional view of still another embodiment of an opener in accordance with the invention.

Alternatively, a pair of the screws 44 and corresponding openings and apertures may be used to resist movement of the member 34 (FIG. 8). Also, the member 34 could be glued or otherwise co-formed with the housing 12. However, it is preferred that the member 34 be removable to enable the member 34 to be replaced when it is worn or exchanged with a member sized to remove caps 20 of different size or configuration configuration.

With reference to FIGS. 4 and 5, the bottle 18 is shown positioned within the bore 16 of the opener 10 for removal of the bottle cap 20. As will be appreciated, the cutting surface 30 is not in contact with the foil/paper seal 24 when the cap 20 is received within the member 34 and the neck 26 of the bottle 18 is within the bore 16.

In this regard, it is noted that the cutting surface 30 is preferably provided by a ring of a thin, sturdy material having an edge which may be shaped to be sufficiently sharp so as to cut the seal 24 when pressed against and moved relative to the seal 24. For example, the cutting surface 30 may be provided by a thin circular ring 54 of steel or plastic with an outer tapered edge 56 having sufficient sharpness to cut the seal. Alternatively, the edge 56 may be serrated so that it grips against the seal 24 to tear the seal 24. The ring 54 is preferably frictionally received within a circumferential groove 58 provided on the interior of the cover 14, with the grooves preferably positioned from about 0.5 cm to about 1.5 cm below the housing 12.

In use, the bottle 18 and cap 20 are positioned as shown in FIG. 4 and the bottle 18 maintained stationary by one hand of the user and the opener 10 gripped by the other hand of the user with a downward pressure to bear the cap 20 against the surface 36. Then, as shown in FIG. 5, the user may twist the opener 10 in the direction of the arrow A to unscrew the cap 20 while simultaneously squeezing lower end 59 of the outer covering 14 against the neck 26 of the bottle 18 to cut or tear the seal 24 along tear or cut line 60. As will be appreciated, the cut line 60 is located sufficiently below the lip 22 of the bottle 18 such that the portion of the seal 24 which remains below the cut line 60 is sufficiently below the opening of the bottle so that the remaining seal does not contact the mouth of the user when drinking from the bottle 18.

Figure 6:
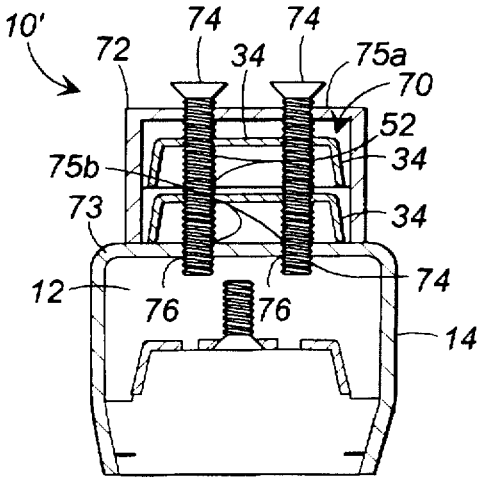
FIG. 6 is a cross sectional view of another embodiment of an opener in accordance with the invention.

With reference to FIG. 6, there is shown another embodiment of an opener 10' in accordance with the invention. The opener 10' is identical to the opener 10, except that it further includes a storage compartment 70 located above the housing 12 for storing extra cap engagement members 34. In this regard, the compartment 70 is preferably provided by a plastic cap-shaped member 72 sized to fit over a flat top portion 73 of the housing member 12 and of sufficient height to accommodate a desired number of the members 34.

The member 72 may be secured to the housing member 12 as by screws 74 inserted through apertures 75*a* provided through the top 73 of the member 72 and threadably received through openings 75*b* in the covering 14 and corresponding threaded openings 76 provided into the top of the housing member 12. As will be noted, the screws 74 are sized and spaced to be received through the apertures 52 of the cap engagement members 34 stored within the compartment 70.

Figure 7:
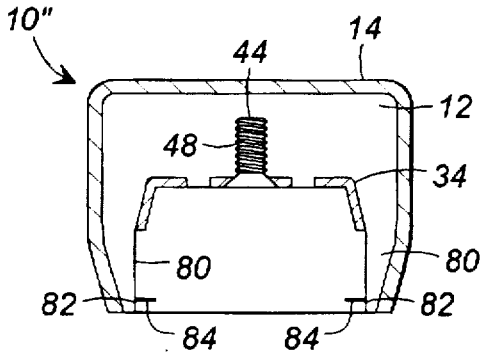
FIG. 7 is a cross sectional view of yet another embodiment of an opener in accordance with the invention.

Turning now to FIG. 7, there is shown another embodiment of an opener 10" in accordance with the invention. The opener 10" is preferably identical to the opener 10, except the housing member 12' includes an annular leg portion 80 which extends to substantially the same length as the covering 14. As will be appreciated, the leg portion 80 includes a circumferential groove 82 for receiving a circular ring 84 such as the ring 54. In addition, the leg portion 80 is preferably sufficiently pliant so that it may be squeezed inwardly to bear or urge the cutting surface 30 of the ring 84 against the seal 24 of the bottle 18 during opening, in the manner described previously for the ring 54 and cutting surface 30 in connection with FIG. 5. As will be appreciated, the pliancy of the leg portion 80, particularly if made of a plastic, will generally depend upon the thickness of the leg portion 80.

With reference to FIG. 8, there is shown a further embodiment 90 having a housing 92 shaped to resemble the appearance of a beer bottle. If desired, the exterior of the housing or a portion thereof may be provided with a covering 94, such as the material used for the covering 14, to aid the user in gripping the opener 90. As in the embodiment of FIG. 7, the housing 92 also preferably includes leg portion 96 and ring 98 corresponding to the leg portion 80 and ring 54 described in connection with FIG. 7. The cap engagement member 34' may be maintained adjacent the bottom of the housing 92 by use of a pair of the screws 44 inserted through apertures 100 provided through the member 34' and threadably received into threaded openings 102 of the housing 92.

As will be appreciated, bottle openers provided in accordance with the invention offer significant advantages over prior openers. For example, bottle openers in accordance with the invention not only facilitate the opening of bottles, but further enable convenient removal of both the cap and portions of the seal in one step. In addition, by using the bottle opener in accordance with the invention, the cap is not deformed during opening of the bottle and the cap can later be replaced on the bottle, in order to preserve the contents of the bottle. In this regard, it is noted that the opener may be manipulated in a reverse direction to tightly reinstall the cap.

The foregoing description of certain embodiments of the present invention has been provided for purposes of illustration only, and it will be understood that changes and modifications may be made by those of ordinary skill within the scope and spirit of the following claims.

What is claimed is:

1. A bottle opener for opening bottles having a cap threadably received over an upper opening of the bottle and a sheet material secured over at least a portion of the cap and a portion of the bottle, the opener comprising:

a housing member having a generally U-shaped cross section, the housing member including an outer surface configured for grasping by a hand of a user and an interior position configured to receive the cap of the bottle and an upper portion of the bottle below the cap over which at least a portion of the sheet material is attached;

a substantially rigid cap engaging member rigidly secured adjacent the interior portion of the housing for receivable engaging at least a portion of the cap when the cap is inserted into the interior portion of the body member such as when the body is moved opposite the threaded direction of the cap, the cap is caused to move with the cap engaging member to unthread the cap from the bottle;

a substantially continuous cutting surface positioned adjacent the interior portion of the housing and positionable for forcibly contacting the sheet material at a location below the bottle cap for substantially continuous disruption of the sheet material adjacent a disruption line of the sheet material positioned below the upper opening of the bottle during unthreading of the cap from the bottle so that the portion of the sheet material above the disruption line is removable from the bottle with the cap when the cap is unthreaded from the bottle, wherein the housing member includes a surface recessed within a blind bore for fixedly receiving the cap engaging member.

2. A bottle opener for opening bottles having a cap threadably received over an upper opening of the bottle and a sheet material secured over at least a portion of the cap and a portion of the bottle, the opener comprising:

a housing member having a generally U-shaped cross section, the housing member including an outer surface configured for grasping by a hand of a user and an interior portion configured to receive the cap of the bottle and an upper portion of the bottle below the cap over which at least a portion of the sheet material is attached;

a substantially rigid cap engaging member rigidly secured adjacent the interior portion of the housing for receivably engaging at least a portion of the cap when the cap is inserted into the interior portion of the body member such as when the body is moved opposite the threaded direction of the cap, the cap is caused to move with the cap engaging member to unthread the cap from the bottle;

a substantially continuous cutting surface positioned adjacent the interior portion of the housing and positionable for forcibly contacting the sheet material at a location below the bottle cap for substantially continuous disruption of the sheet material adjacent a disruption line of the sheet material positioned below the upper opening of the bottle during unthreading of the cap from the bottle so that the portion of the sheet material above the disruption line is removable from the bottle with the cap when the cap is unthreaded from the bottle, the cap engaging member includes a substantially circular and flat upper portion configured to bear against a portion of the bottle cap and a sidewall depending from the upper portion of the member, the sidewall having a plurality of ridges for engaging a portion of the bottle cap.

3. A bottle opener for opening bottles having a cap threadably received over an upper opening of the bottle and a sheet material secured over at least a portion of the cap and a portion of the bottle, the opener comprising:

a housing member having a generally U-shaped cross section, the housing member including an outer surface configured for grasping by a hand of a user and an interior portion configured to receive the cap of the bottle and an upper portion of the bottle below the cap over which at least a portion of the sheet material is attached;

a substantially rigid cap engaging member rigidly secured adjacent the interior portion of the housing for receivably engaging at least a portion of the cap when the cap is inserted into the interior portion of the body member such as when the body is moved opposite the threaded direction of the cap, the cap is caused to move with the cap engaging member to unthread the cap from the bottle;

a substantially continuous cutting surface positioned adjacent the interior portion of the housing and positionable for forcibly contacting the sheet material at a location below the bottle cap for substantially continuous disruption of the sheet material adjacent a disruption line of the sheet material positioned below the upper opening of the bottle during unthreading of the cap from the bottle so that the portion of the sheet material above the disruption line is removable from the bottle with the cap when the cap is unthreaded from the bottle, wherein the cutting surface comprises a substantially sharp outwardly facing surface of a relatively thin flat ring.

4. A bottle opener for opening bottles having a cap threadably received over an upper opening of the bottle and a sheet material secured over at least a portion of the cap and a portion of the bottle, the opener comprising:

a housing member having a generally U-shaped cross section, the housing member including an outer surface configured for grasping by a hand of a user and an interior portion configured to receive the cap of the bottle and an upper portion of the bottle below the cap over which at least a portion of the sheet material is attached;

a substantially rigid cap engaging member rigidly secured adjacent the interior portion of the housing for receivably engaging at least a portion of the cap when the cap is inserted into the interior portion of the body member such as when the body is moved opposite the threaded direction of the cap, the cap is caused to move with the cap engaging member to unthread the cap from the bottle;

a substantially continuous cutting surface positioned adjacent the interior portion of the housing and positionable for forcibly contacting the sheet material at a location below the bottle cap for substantially continuous disruption of the sheet material adjacent a disruption line of the sheet material positioned below the upper opening of the bottle during unthreading of the cap from the bottle so that the portion of the sheet material above the disruption line is removable from the bottle with the cap when the cap is unthreaded from the bottle, wherein the cutting surface comprises a metal ring located within a groove in the outer surface wherein the cutting surface can engage the sheet material when pressure is applied to the cutting surface by the user in order to disrupt the sheet material.

5. A bottle opener for opening bottles of the type having a cap threadably received over an upper opening of the bottle and a sheet material secured over at least a portion of the cap and a portion of the bottle, the opener comprising a substantially rigid cap engagement means for frictionally engaging the cap for the unthreading of the cap from the bottle and sheet material disruption means positioned adjacent the cap engagement means for being squeezed by a user for forcibly contacting the sheet material at a location below the bottle cap for disruption of the sheet material during unthreading of the cap from the bottle, wherein when the opener is operated to remove the cap and disrupt the sheet material, the cap remains frictionally received by the cap engagement means after it has been unthreaded from the bottle and an upper portion of the disrupted sheet material adjacent the opening of the bottle is removable from the bottle with the cap when the cap is unthreaded from the bottle, and a lower portion of the disrupted sheet material remains secured to a portion of the bottle at a location sufficiently below the opening of the bottle so that it does not contact the mouth of the user when drinking from the bottle.

6. The opener of claim 5, wherein the cap engagement means comprises a housing member having a generally U-shaped cross-section, the housing member including an outer surface configured for grasping by a hand of a user and an interior portion configured to receive the cap of the bottle and an upper portion of the bottle below the cap over which at least a portion of the sheet material is attached, and a cap engaging member rigidly secured adjacent the interior portion of the housing for receivably engaging at least a portion of the cap when the cap is inserted into the interior portion of the body member such that when the body is moved opposite the threaded direction of the cap, the cap is caused to move with the cap engaging member to unthread the cap from the bottle.

7. The opener of claim 5, wherein the sheet disruption means comprises a cutting surface positioned adjacent the inner portion of the housing and positionable for contact with the sheet material at a location below the bottle cap for disruption of the sheet material during unthreading of the cap from the bottle.

8. A bottle opener for opening bottles of the type having a cap threadably received over an upper opening of the bottle and a sheet material secured over at least a portion of the cap and a portion of the bottle, the opener comprising:

a housing member having a generally U-shaped cross section, the housing member including an outer surface configured for grasping by a hand of a user and an interior portion configured to receive the cap of the bottle and an upper portion of the bottle below the cap over which at least a portion of the sheet material is attached;

a substantially rigid cap engaging member rigidly secured adjacent the interior portion of the housing for receivably engaging at least a portion of the cap when the cap is inserted into the interior portion of the body member such that when the body is moved opposite the threaded direction of the cap, the cap is caused to move with the cap engaging member to unthread the cap from the bottle, wherein the housing member includes a surface recessed within a blind bore for fixedly receiving a cap engaging member;

a cutting surface positioned adjacent the interior portion of the housing member and positionable for contact with the sheet material at a location below the bottle cap for disruption of the sheet material during unthreading of the cap from the bottle wherein the cutting surface comprises a metal ring located within a groove in the outer surface wherein the cutting surface can engage the sheet material when pressure is applied to the cutting surface by the user in order to disrupt the sheet material.

9. The opener of claim 8, wherein the cap engaging member includes a substantially circular and flat upper portion configured to bear against a portion of the bottle cap and a sidewall depending from the upper portion of the member, the sidewall having a plurality of ridges for engaging a portion of the bottle cap.

10. The opener of claim 8, wherein the cutting surface comprises a substantially sharp outward facing surface of the metal ring, with the ring being deformable so that it may be biased into contact with the sheet material for disruption thereof when the opener is rotated relative to the bottle.

11. The opener of claim 8, wherein the portion of the housing member adjacent the cutting surface is biasable in a direction toward the bottle to enable the cutting surface to be biased against the sheet material.

* * * * *

UNITED STATES PATENT AND TRADEMARK OFFICE

CERTIFICATE OF CORRECTION

PATENT NO. : 5,893,301

DATED : May 6, 1999

INVENTOR(S) : Hensley et al.

It is certified that error appears in the above-identified patent and that said Letters Patent is hereby corrected as shown below:

Col. 6, line 2: change "position" to --portion--

Col. 6, line 7: change "receivable" to --receivably--

Signed and Sealed this

Twenty-seventh Day of July, 1999

*Attest:*

*Attesting Officer*

Q. TODD DICKINSON

*Acting Commissioner of Patents and Trademarks*